US006119499A

United States Patent [19]

Müller

[11] Patent Number: 6,119,499

[45] Date of Patent: Sep. 19, 2000

[54] BAR AND WIRE ROLLING MILL

[75] Inventor: Alfred Müller, Krefeld, Germany

[73] Assignee: SMS Schloemann-Siemag Aktiengesellschaft, Düsseldorf, Germany

[21] Appl. No.: 09/010,282

[22] Filed: Jan. 21, 1998

[30] Foreign Application Priority Data

Jan. 22, 1997 [DE] Germany ..... 197 02 090

[51] Int. Cl.[7] ..... B21B 27/06

[52] U.S. Cl. ..... 72/200

[58] Field of Search ..... 72/200, 201, 222, 72/228, 231, 251; 266/103, 106; 140/1, 2

[56] References Cited

U.S. PATENT DOCUMENTS 4,242,153 12/1980 Vitelli et al. .

OTHER PUBLICATIONS

E. Bruno et al, "Computersimulation Des Walzprozesses Zur Qualitätsoptimierung An Einer Feinstahl—Und Drahtstrasse", Bd. 114, No.11, Nov. 7, 1994.

*Primary Examiner*—Rodney A. Butler

*Attorney, Agent, or Firm*—Friedrich Kueffner

[57] ABSTRACT

A bar and wire rolling mill includes a cooling bed line for bars, a rotary basket reeling line for bars coiled into coils, and a wire line with a looper and winding collector for wire, and a holding furnace arranged downstream for thermal aftertreatments of the rolled material leaving the rolling mill. The cooling line, the rotary basket reeling line and the wire line are connected to a common holding furnace through transport devices.

8 Claims, 2 Drawing Sheets

BAR AND WIRE ROLLING MILL

BACKGROUND OF THE INVENTION

1. Field of the Invention

The present invention relates to a bar and wire rolling mill with a cooling bed line for bars, a rotary basket reeling line for bars coiled into coils, and a wire line with a looper and winding collector for wire, and a holding furnace arranged downstream for thermal aftertreatments of the rolled material leaving the rolling mill.

2. Description of the Related Art

Bar and wire rolling mills of the above-described type are known in the art. In these mills, bars are either rolled, cut, cooled and bundled, or rolled bars are coiled in rotary basket reels, cooled and bundled, or wire is placed in windings, the cooled wire is collected in wire bundles and is subsequently bound. Such bar and wire trains can be used for most steel qualities to be processed. However, in contrast to other methods without thermal intermediate treatment or aftertreatment, for example, cooling, when e.g. cold work steels or high-speed steels are rolled and fed to the appropriate lines, these steels must transform isothermally over a longer period of time until a desired material structure is reached or until the desired material properties are reached.

For this purpose, individual lines, i.e., either wire lines or bar lines have been proposed in which equalizing furnaces are provided instead of the cooling stretches. It has also already been proposed to provide an appropriate equalizing furnace parallel to the cooling stretch in order to take out of the line that material which must be fed to the isothermal treatment. In the past, it was not possible to roll rolling stock which had to be subjected to an isothermal aftertreatment over longer periods of time in combined bar and wire rolling mills.

SUMMARY OF THE INVENTION

Therefore, it is the primary object of the present invention to further develop a bar and wire rolling mill of the above-described type in such a way that in addition to normal steel qualities it is possible to roll steels which must be treated isothermally over a longer period of time; in addition, the mill is to require little space and should be inexpensive to set up.

In accordance with the present invention, the cooling line, the rotary basket reeling line and the wire line are connected to a common holding furnace through transport devices.

As a result of the configuration according to the present invention, it is possible to roll in addition to the usual steel qualities also those steel qualities into bars or wire which require a long isothermal treatment after the rolling process. The usual steel qualities leave the line after appropriate cooling and subsequent bundling, while, for example, cold work steel or high-speed steel are moved by means of the transport devices to the holding furnace.

In accordance with an advantageous feature, the transport devices include bar collection boxes, rotary basket reel coil pallets and wire coil mandrel pallets, and transfer stations are arranged in the cooling bed line, the rotary basket reeling line and the wire line for transferring the rolling stock to the bar collection boxes, rotary basket reel coil pallets and wire coil mandrel pallets and from there to the holding furnace. The transfer stations ensure that the bar material or the wire are removed from the respective lines and can be fed through the bar collection boxes, rotary basket reel coil pallets and wire coil mandrel pallets to the holding furnace.

In accordance with a useful feature, in order to prevent the bars or wires to be removed from the respective lines from cooling off too much, the transfer stations are arranged in conveying direction of the rolling stock in front of the cooling beds or the longitudinal transport devices of the respective lines in the vicinity of the holding furnace.

If the transport device includes an insulating tunnel storage unit, the bar collection boxes as well as the pallets can be heated in the holding furnace and placed in the storage units to be ready when needed. Thus, heated bar collection boxes or pallets are always available for the rolling stock to be introduced into the holding furnace. The use of heated bar collection boxes and pallets is of particular significance because this prevents the rolling stock from cooling off too much in parts thereof when contacting any cold locations of the bar collection boxes or pallets, so that at the points of contact no locations are created which may later not have the desired material structure. Because the bar collection boxes and the pallets are heated and stored in the heated state, it is made possible that the rolling stock retains a uniform temperature even when loading the boxes or pallets.

If the transport device includes circulating roller tables which include the holding furnace, no jams or problems can occur when the bar collection boxes, rotary basket reel coil pallets and wire coil mandrel pallets are conveyed to and from the holding furnace.

In addition to but also instead of the insulating tunnel storage units, the roller tables may be constructed as thermally insulated roller tables in order to keep the temperature loss during transport as low as possible, but also to be able to utilize the roller tables as storage roller tables.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DESCRIPTION OF THE PREFERRED EMBODIMENTS

Figure 1:
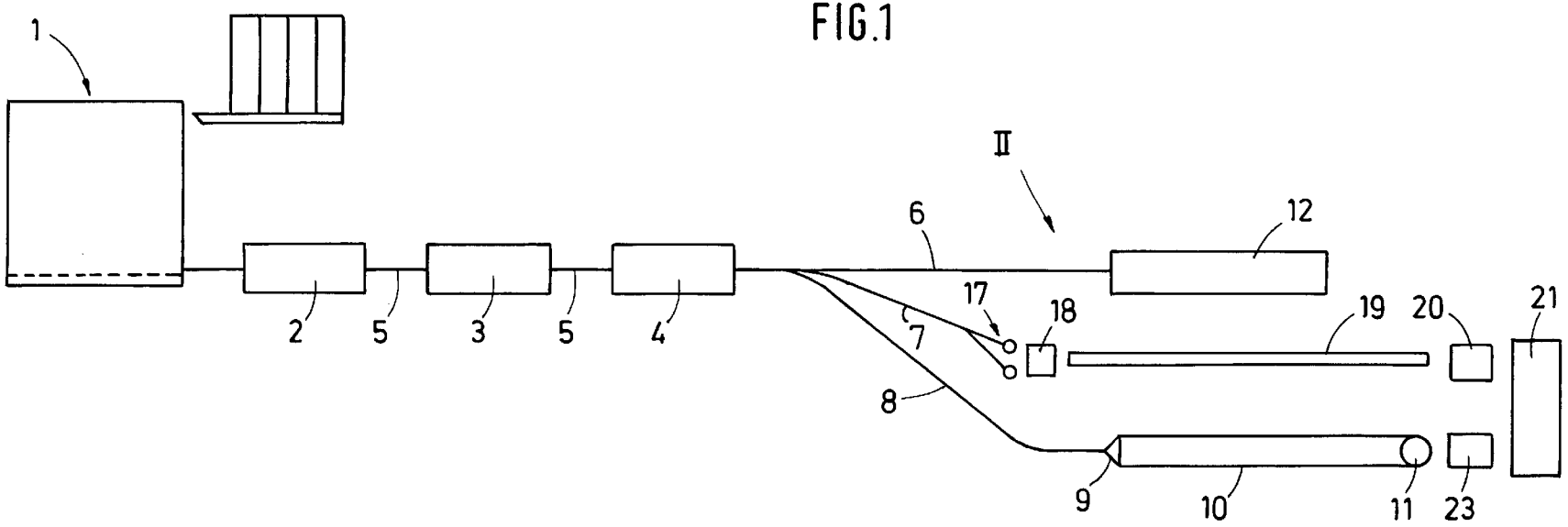
FIG. 1 is a schematic illustration of the rolling mill according to the present invention.

FIG. 1 of the drawing shows a billet heating furnace 1 which is followed by the profile roll stand groups 2, 3 and 4, wherein material having different thicknesses such as bar material or wire material can be rolled by using a different number of adjusted rolls in these roll stand groups 2, 3 and 4. Downstream of the roll stand 4, the rolling line 5 branches into a cooling bed line 6, a rotary basket reeling line 7 and a wire line 8 with a looper 9, a cooling bed 10 and a winding collector 11.

Figure 2:
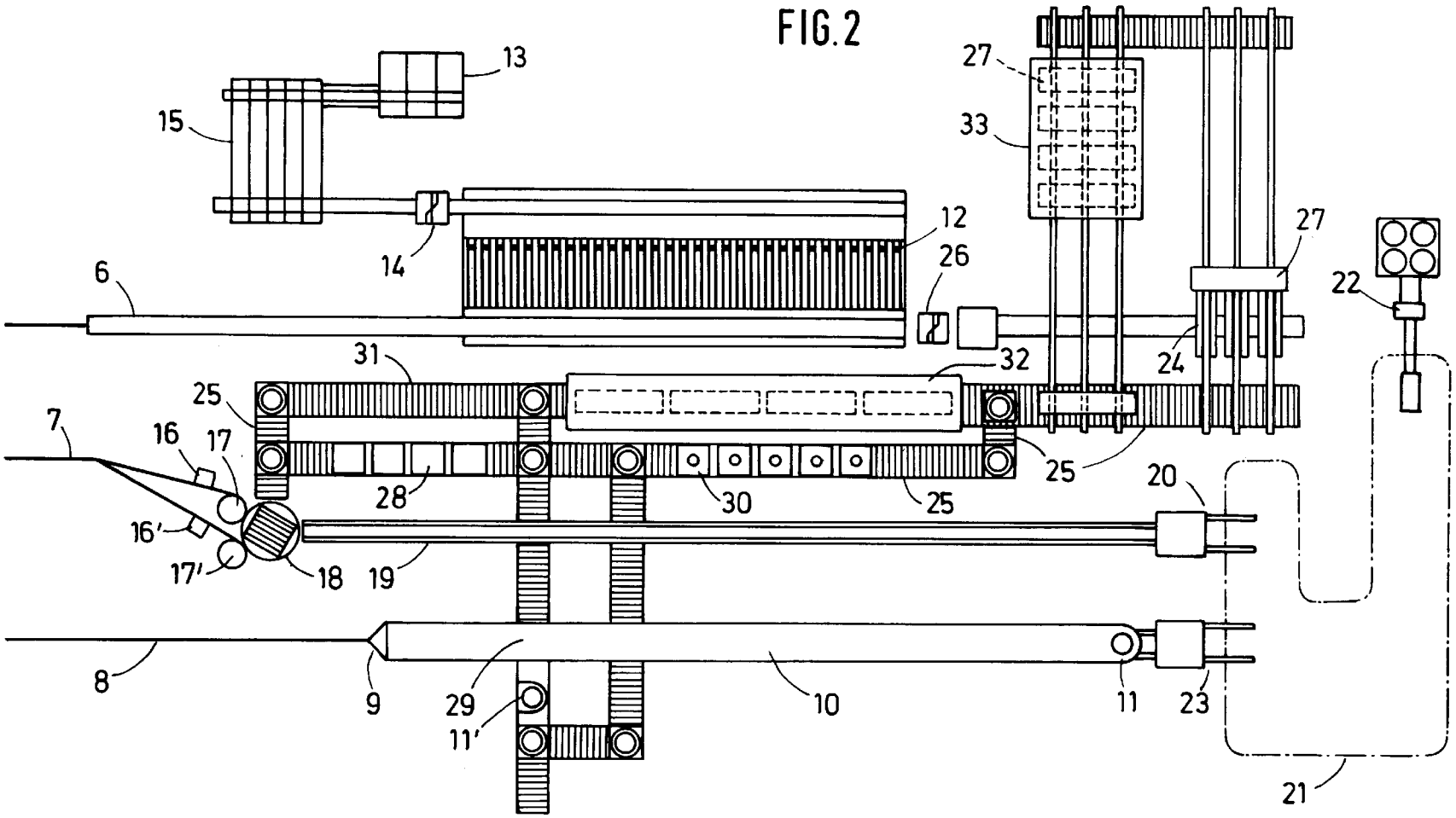
FIG. 2 is a schematic illustration, on a larger scale, of the exit side of the rolling mill of FIG. 1.

FIG. 2 of the drawing shows the cooling bed line 6, the rotary basket reeling line 7 and the wire line 8. The cooling bed line 6 is essentially composed of a cooling bed 12. The bars can be moved from the cooling bed 12 to a bundling station through a shear 14 in which the bars are cut to commercial lengths and to a transverse conveyor 15.

The rotary basket reeling line 7 includes drivers 16, 16' as well as rotary basket reels 17, 17'. The rotary basket reels 17, 17' are followed by a transfer station 18 by means of which the bars of the two rotary basket reels 17, 17' coiled into coils can be transferred to a longitudinal transport device 19. At the end of the longitudinal transport device 19 is provided an upender 20 by means of which the bar bundles can be tilted and transported to a hook conveyor 21 in order to be conveyed by the hook conveyor 21 to the coil binding press 22.

Illustrated in the wire line 8 are the looper 9, the Stelmor cooling bed 10, the winding collector 11 as well as an upender 23 which also cooperates with the hook conveyor 21 and the coil binding press 22.

Arranged at the cooling bed line 6 is a transfer station 24 for transferring the bars to a bar collection box 27 which is movably mounted on a transport device 25, wherein a shear 26 is capable of cutting the bars into lengths which correspond to the internal dimensions of the bar collection boxes 27. The transfer station 18 in the rotary basket reeling line 7 is also capable of transferring the bars coiled into coils to pallets 28 of the transport device 25. The wire which has been placed into windings can be collected on a mandrel pallet 30 and transferred to the transport device 25 by means of a transfer station 29 in the wire line 8.

The transport device 25 is composed of circulating roller tables 31 on which the bar collection boxes 27, the pallets 28 and the mandrel pallets 30 can be transported. The transport device 25 has the purpose of feeding the bars or bar bundles or wire coils as well as the empty bar collection boxes 27, pallets 28 and mandrel pallets 30 to a holding furnace 32.

Next to the roller table 31 constructed as a storage roller table with appropriate thermal insulation, the transport device 25 is provided with an insulating storage unit 33 which, in addition to the thermally insulated storage roller table 31, is capable of receiving bar collection boxes 27.

As a rule, the rolling mill illustrated in FIGS. 1 and 2 is used for rolling, dividing, cooling and bundling conventional steel qualities. However, when steel qualities are to be rolled which require a long isothermal treatment, for example, bars are placed by means of the transfer station 24 into bar collection boxes 27 which previously were heated in the holding furnace 32, were moved over the roller tables 31 to the insulating tunnel storage unit 33 and from the latter to the transfer station 24. The bar collection boxes 27 containing the bars are moved to the holding furnace 32 and are subjected in the holding furnace 32 to the required isothermal treatment.

The bars coiled into coils in the wire basket reel 17, 17' are subjected to a similar treatment. The bar coils are placed by means of the transfer station 18 on pallets 28 which were previously heated in the holding furnace 32 and were subjected to intermediate storage on the storage roller table 31 and are then transported over the roller table 31 to the holding furnace 32.

If wire is to be treated isothermally, the transfer station 29 is activated. For this purpose, a portion of the Stelmor cooling bed 10 is moved out of the wire line 8 and replaced by a winding collector 11'. The storage roller table 31 extends underneath the winding collector 11', wherein preheated mandrel pallets 30 which may have been subjected to intermediate storage on the storage roller table 31 are arranged on the roller table 31 and can receive wire windings arriving from the winding collector 11'. The wire coil is transferred into the holding furnace 32 by the storage roller table 31.

While specific embodiments of the invention have been shown and described in detail to illustrate the inventive principles, it will be understood that the invention may be embodied otherwise without departing from such principles.

What is claimed is:

1. A bar and wire rolling mill comprising a rolling line branching at a branching point into a cooling bed line for bars, a rotary basket reeling line for bars coiled into coils, and a wire line with a looper and winding collector for wire, and a common holding furnace arranged downstream of the branching point for carrying out thermal aftertreatments of rolling stock leaving the rolling mill, further comprising transport devices connecting the cooling bed line, the rotary basket reeling line and the wire line to the common holding furnace.

2. The bar and wire rolling mill according to claim 1, wherein the transport devices comprise bar collection boxes, rotary basket reeling coil pallets and wire coil mandrel pallets, and wherein the cooling bed line, the wire basket reeling line and the wire line comprise transfer stations for transferring the rolling stock into the bar collection boxes onto, the rotary basket reeling coil pallets and the wire coil mandrel pallets, and for moving the rolling stock by the bar collection boxes, the rotary basket reel coil pallets and wire coil mandrel pallets to the holding furnace.

3. The bar and wire rolling mill according to claim 1, wherein the transport devices comprise insulating tunnel storage units.

4. The bar and wire rolling mill according to claim 1, wherein the transport devices comprise circulating roller tables which include the holding furnace.

5. The bar and wire rolling mill according to claim 2, wherein the transfer stations are arranged in a transport direction of the rolling stock in front of cooling beds and longitudinal transport devices of the lines.

6. The bar and wire rolling mill according to claim 2, wherein the bar collection boxes, the rotary basket reeling coil pallets and the wire coil mandrel pallets are configured to pass the holding furnace for heating and to be returned to the holding furnace after the rolling stock has been transferred to the bar collection boxes, the rotary basket reeling coil pallets and the wire coil mandrel pallets.

7. The bar and wire rolling mill according to claim 4, wherein the roller tables are thermally insulated roller tables.

8. The bar and wire rolling mill according to claim 4, wherein the roller tables are storage roller tables, further comprising bar collection boxes, rotary basket reeling coil pallets and wire coil mandrel pallets for transporting the rolling stock on the storage roller tables.

* * * * *